United States Patent [19]

Misumi et al.

[11] 4,146,393

[45] Mar. 27, 1979

[54] BASE METAL PLATE MATERIALS FOR DIRECTLY HEATED OXIDE CATHODE

[75] Inventors: Akira Misumi; Masaharu Kumada, both of Mobara, Japan

[73] Assignee: Hitachi, Ltd., Japan

[21] Appl. No.: 823,653

[22] Filed: Aug. 11, 1977

[30] Foreign Application Priority Data

Sep. 22, 1976 [JP] Japan ..... 51-113105

[51] Int. Cl.[2] ..... C22C 19/03

[52] U.S. Cl. ..... 75/170; 148/32

[58] Field of Search ..... 75/170; 148/32

[56] References Cited

U.S. PATENT DOCUMENTS 2,921,850 1/1960 Inouye et al. ..... 75/170

*Primary Examiner*—R. Dean

*Attorney, Agent, or Firm*—Craig & Antonelli

[57] ABSTRACT

Base metal plate materials for a directly heated oxide cathode consisting mainly of nickel and containing 10–22% by weight of molybdenum, 1–8% by weight of tungsten and a small amount of at least one reducing agent such as zirconium can make the oxide layer of the cathode more difficult to be peeled off and are almost similar in mechanical strengths at high temperatures, specific electric resistance and the diffusion velocity of zirconium as compared with prior art materials consisting mainly of nickel and containing 20–30% by weight of tungsten and 0.3–5% by weight of zirconium, and can further permit maintenance of the electron emissive ability of the oxide cathode.

4 Claims, 3 Drawing Figures

BASE METAL PLATE MATERIALS FOR DIRECTLY HEATED OXIDE CATHODE

LIST OF PRIOR ART (37 CFR 1.56 (a))

The following references are cited to show the state of the art:

Japanese Patent Kokoku (Post-Exam. Publn.) No. 12,266/69

Japanese Patent Kokoku (Post-Exam. Publn.) No. 21,008/69

The present invention relates to base metal plate materials for a directly heated oxide cathode.

In general, cathodes are used in a receiving tube, a discharge tube or a cathode-ray tube, etc. It is generally required for ones used in the cathode-ray tube to be able to operate rapidly and display an image instantaneously after electric power is supplied. In other words, it is required that a starting time is short.

On the one hand, the above-mentioned cathodes are classified into indirectly heated ones and directly heated ones. In the case of indirectly heated ones, a starting time is almost 20 seconds, while the time is as very short as 1–2 seconds in the case of directly heated ones. The directly heated oxide cathodes are most suitable as a quick operating cathode.

Prior art base metal plate materials for a directly heated oxide cathode and the base metal plate materials for a directly heated oxide cathode according to the present invention will be explained below in detail referring to the accompanying drawings in which.

Figure 3:
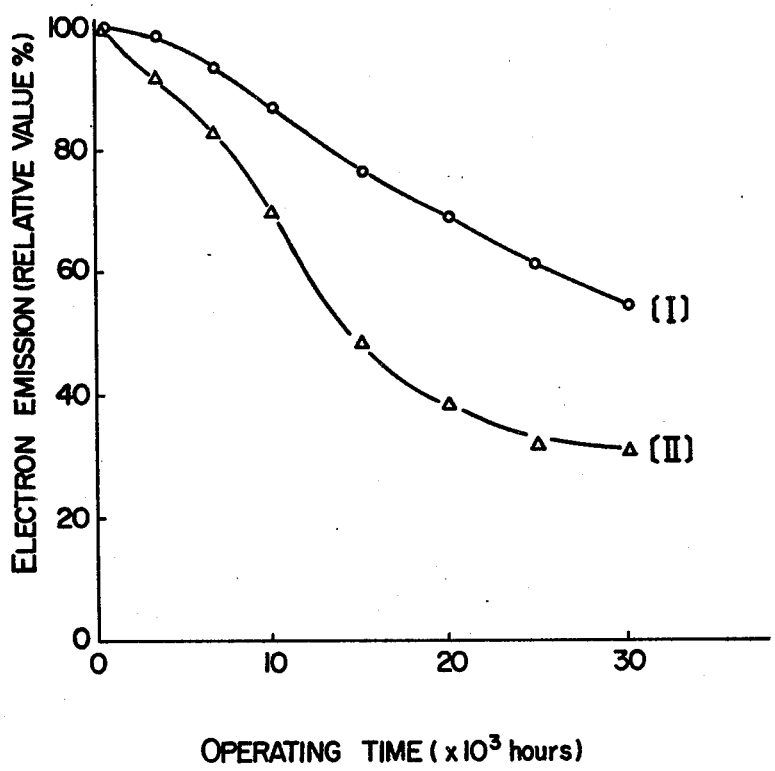

Also, FIG. 3 shows a relationship between electron emission and operating time for a directly heated oxide cathode according to the present invention and a prior art directly heated oxide cathode.

Figure 1:
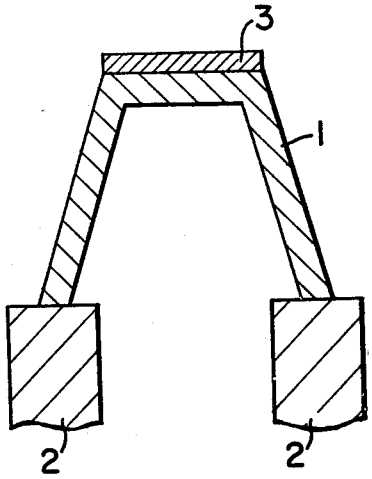
FIG. 1 is a sectional view of the principal part of one example of prior art directly heated oxide cathodes.
Figure 2:
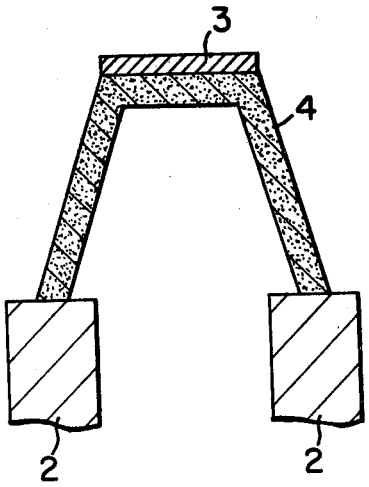
FIG. 2 is a sectional view of the principal part of one example of directly heated oxide cathodes using a base metal plate material according to the present invention.

In the FIGS. 1–2, the respective numerals represent the following meanings:

1 . . . Base, 2 . . . Terminals,
3 . . . Alkaline earth metal oxide layer,
4 . . . Base In FIG. 1, 1 is a base which is heated by the supply of an electric current, and 2 is terminals thereof. Also, 3 is an alkaline earth metal oxide layer which emits electrons, for example, a layer of a mixture of barium oxide, strontium oxide and calcium oxide. The oxide layer is provided at a fixed part on the one surface of said base 1 to form a directly heated oxide cathode. Here, it is necessary for the base 1 to be 100 μm or less, and preferably 60 μm or less, in thickness so that its electric resistance may be as large as possible, its thermal capacity may be reduced and starting time may become short.

In the directly heated oxide cathode thus formed, the metal plate material used in the base 1 should satisfy the following conditions:

(1) Its mechanical strengths at high temperatures are as high as possible.
(2) Its specific electric resistance is higher than a predetermined value, for example, 90 μΩcm at 900° C.
(3) The electron emission of the alkaline earth metal oxide cathode is satisfactory.

As such a material, alloys comprising nickel as a main component, 20–30% by weight of tungsten and an impurity amount of a reducing agent such as Mg, Si, Ti, Al or Zr are known [Japanese Patent Kokoku (Post-Exam. Publn.) No. 21,008/69]. MISUMI, who is one of the present inventors, suggested in co-pending U.S. patent application Ser. No. 710,161, filed July 30, 1976, now U.S. Pat. No. 4,079,164 an improved base metal which can maintain its electron emission for a long period of time and which is fundamentally an Ni- W - Zr alloy containing 20–30% by weight of tungsten and 0.3–5.0% by weight of zirconium. The main reason why tungsten is added here is that it satisfies the above-mentioned conditions required for the base 1. Therefore, it is most suitable to add 20–30% by weight of tungsten.

When a metal plate material having the above-mentioned composition is used as said base 1, however, the material has a defect in that, in the step of producing a cathode-ray tube and during the operation of the cathode, a large amount of a tungstate interface layer (not shown) is formed between the base 1 and the oxide layer 3 and the oxide layer 3 becomes easy to be peeled off owing to this tungstate interface layer [Japanese Patent Kokoku (Post-Exam. Publn.) No. 12,266/69]. Further, it is stated in the Japanese patent publication that molybdenum is more difficult to form an interface layer than tungsten.

In order to obviate the above-mentioned defect, therefore, the present inventors attempted previously an improvement in the directly heated oxide cathode by replacing tungsten by molybdenum. Since molybdenum is lower than tungsten in reactivity with the oxide layer 3, a molybdate interface layer is substantially not formed. It was confirmed that the peeling of the oxide layer 3 became difficult to occur as compared with the use of tungsten when molybdenum was used in place of tungsten. Also, mechanical strengths at high temperatures, specific electric resistance and the diffusion velocity of zirconium were also similar to those obtained by the use of tungsten.

For example, when the mechanical strengths at high temperatures, specific electric resistance and zirconium diffusion velocity for the directly heated oxide cathode formed with an alloy comprising 82.1% by weight of nickel, 17.5% by weight of molybdenum and 0.4% by weight of zirconium were measured, it was found that this cathode formed with the Ni - Mo - Zr alloy material was almost similar in all the above-mentioned properties to a cathode formed with a Ni - W - Zr alloy comprising 72.1% by weight of nickel, 27.5% by weight of tungsten and 0.4% by weight of zirconium as shown in the following table:

Table

| | Specific electric resistance (20° C, μΩcm) | Tensile strength (800° C, kg/mm²) | Zr diffusion coefficient D (800° C, cm²/sec) |
|---|---|---|---|
| Ni—Mo—Zr | 89 | 37 | $1.5 \times 10^{-11}$ |
| Ni—W—Zr | 84 | 40 | $1.4 \times 10^{-11}$ |

Also, a ternary carbonate comprising $BaCO_3$, $SrCO_3$ and $CaCO_3$ was coated onto a fixed surface at the top of said base 4 formed with the above-mentioned Ni - Mo - Zr alloy and the resulting coating was subjected to heat treatment in a vacuum atmosphere at 1000° C. for about 10 hours to convert the carbonate layer into an oxide layer 3. When the adhesive strength of the oxide layer 3 was examined by scratching the oxide layer 3 with the tip of a setting pin in a vacuum, the peeling of the oxide layer 3 occurred in the case of the Ni - W - Zr alloy material but the peeling of the oxide layer 3 did not occur at all in the case of the Ni - Mo - Zr alloy material. Also, with regard to the same samples, X-ray diffraction test was carried out after the samples were taken out in the air and freed from the oxide layer 3 with methanol. As a result, a tungstate interface layer was detected in the case of the Ni - W - Zr alloy material but a molybdate interface layer was not detected at all in the case of the Ni - Mo - Zr alloy material.

In the directly heated oxide cathode formed by the use of a base of the above-mentioned composition, however, the molybdenum contained in the base 1 is low in reducing velocity and thereby the reducing action is borne mainly by zirconium. In this case, zirconium as a reducing agent gradually decreases during the operation of the cathode while reducing the oxide layer 3 until it is exhausted and the electron emissive activity of the oxide layer 3 is lost. The electron emissive ability will be maintained for a long period of time by increasing the zirconium content. However, there is an upper limit for the zirconium content since a low melting eutectic is produced and thereby mechanical strengths at high temperatures are reduced at the zirconium content exceeding 5% by weight. Therefore, the reducing action of the oxide layer 3 and in turn the duration of electron emissive ability are limited by the amount of zirconium.

Therefore, an object of the present invention is to obviate the above-mentioned defects.

Another object of the invention is to provide a directly heated oxide cathode which can maintain advantages of a base 1 of the above-mentioned composition and simultaneously can maintain an electron emissive ability for a long period of time.

Another object of the invention is to provide a directly heated oxide cathode, which is difficult to cause the peeling of the oxide layer and can maintain the electron emissive ability of the oxide cathode even after zirconium as one reducing agent was exhausted and sufficient supplement thereof became impossible, by adding to nickel containing zirconium a small amount of tungsten together with molybdenum.

The other objects and advantages of the present invention will be apparent from the following description.

According to the present invention, there is provided a base metal plate material for a directly heated oxide cathode consisting mainly of nickel and containing 10–22% by weight of molybdenum, 1–8% by weight of tungsten and a small amount of at least one reducing agent.

In order to achieve the above-mentioned objects, the base metal plate material for a directly heated oxide cathode according to the present invention, contains molybdenum, thereby its mechanical strengths at high temperatures and specific electric resistance being increased. On the one hand, the base metal plate material contains such an amount of tungsten as a large amount of a tungstate interface layer is not formed in the step of forming the oxide layer by the thermal decomposition of alkaline earth metal carbonates and at the beginning of its life when the atmosphere in the tube is bad, thereby the electron emissive ability of the oxide cathode being maintained when a reducing agent is exhausted and sufficient supplement of the reducing agent becomes impossible.

In FIG. 2 which is a sectional view of the principal part of one example of directly heated oxide cathodes using a base metal plate material according to the present invention, a base 4 is produced by forming an alloy ingot comprising 15% by weight of molybdenum, 4% by weight of tungsten, 0.4% weight of zirconium and the balance of nickel according to a standard powder metallurgy process, and then forming a base metal plate material for a cathode of about 30 μm in thickness by cold rolling while the ingot is subjected to vacuum annealing repeatedly. A directly heated oxide cathode is formed by the use of this plate material.

In the directly heated oxide cathode thus formed, the mechanical strengths at high temperatures, specific electric resistance and zirconium diffusion velocity were measured. As a result, it was found that this plate material formed with an alloy comprising 80.6% by weight of nickel, 15% by weight of molybdenum, 0.4% by weight of zirconium and 4% by weight of tungsten was almost similar in all the above-mentioned properties to a tungsten-free plate material formed with an alloy comprising 82.1% by weight of nickel, 17.5% by weight of molybdenum and 0.4% by weight of zirconium. Thus, prescribed values of strengths at high temperatures and specific electric resistance can be obtained by containing 15% by weight of molybdenum. Also, since a small amount (4% by weight) of tungsten is added, this tungsten reduces the oxide layer 3 and the electron emissive ability of the oxide cathode can be maintained for a long period of time even after zirconium (0.4% by weight) as a reducing agent was exhausted.

Various experiments were carried out in the above-mentioned construction to confirm the effects of the construction. A ternary carbonate mixture comprising $BaCO_3$, $SrCO_3$ and $CaCO_3$ was coated on the fixed surface at the top of said base 4 and the resulting coating was subjected to thermal decomposition in a vacuum atmosphere at 1000° C. for about 10 hours to convert the carbonate layer into an oxide layer 3. When the adhesive strength of the oxide layer 3 was examined by scratching the oxide layer 3 with the tip of a setting pin in a vacuum, the peeling of the oxide layer 3 did not occur at all. Also, with regard to the same sample, X-ray diffraction test was carried out after the sample was taken out in the air and freed from the oxide layer 3 with methanol. As a result, neither molybdate interface layer nor tungstate interface layer was detected. A relationship between electron emission and operating time found when said oxide layer 3 comprising BaO, SrO and CaO is formed on a fixed surface of the top of the base 4 and the directly heated oxide cathode thus obtained is actually installed in a color television cathode-ray tube is shown in FIG. 3. In FIG. 3, curve [I] shows the electron emission life of a cathode formed with a base metal plate material (thickness 30 μm) according to the present invention comprising 15% by weight of molybdenum, 4% by weight of tungsten, 0.4% by weight of zirconium and the balance of nickel. Also, curve [II] shows the electron emission life of a cathode formed with a prior art base metal plate material comprising 27.5% by weight of tungsten, 0.4% by weight of zirconium and the balance of nickel. As is clear from FIG. 3, a directly heated oxide cathode formed with a base metal plate material according to the present invention has a remarkably prolonged electron emission life.

The above-mentioned example was explained with regard to a composition of 15% by weight of molybdenum, 4% by weight of tungsten and 0.4% by weight of zirconium, but the present invention is not limited to this composition. If the amount of molybdenum is less than 10% by weight, satisfactory specific electric resistance and mechanical strengths at high temperatures can not be secured. Also, the amount of molybdenum of more than 22% by weight exceeds the solid solution limit and separation of molybdenum is caused by repeated heating and cooling. Therefore, the amount of molybdenum must be 10 to 22% by weight. Also, as for the amount of tungsten, the amount of tungsten of less than 1% by weight is not enough to maintain the electron emissive ability of an oxide cathode which is an object of the present invention. Also, at the amount of tungsten exceeding 8% by weight, a tungstate interface layer is formed during thermal decomposition of alkaline earth metal carbonates in the step of producing an oxide layer and in the initial stage of operation. It causes the peeling of the oxide and prevents tungsten from reacting with the oxide layer, in other words, prevents the reducing action of tungsten. Therefore, the amount of tungsten must be 1 to 8% by weight. Further, as for the amount of zirconium, good initial properties can not be obtained at the amount of zirconium of less than 0.1% by weight, and a low melting eutectic is formed and mechanical strengths at high temperatures are deteriorated at the amount of zirconium exceeding 5% by weight. Therefore, the amount of zirconium must be 0.1 to 5% by weight.

As explained above, in base metal plate materials for a directly heated oxide cathode according to the present invention consisting mainly of nickel and containing 10–22% by weight of molybdenum, 1–8% by weight of tungsten and a small amount of at least one reducing agent, the formation of a tungstate interface layer between the base and the oxide layer can be prevented and thereby the peeling of the oxide layer can be prevented. Further, a satisfactory amount of alkaline earth metals such as Ba, Ca and Sr can be generated and the electron emissive ability of the oxide layer can be maintained for a long period of time. As a result, the life of the directly heated oxide cathode formed with this base metal plate material can be remarkably prolonged.

What is claimed is:

1. A base metal plate material for a directly heated oxide cathode consisting essentially of 10–22% by weight of molybdenum, 1–8% by weight of tungsten, 0.1–5% by weight of zirconium and the balance of nickel.

2. A base metal plate material for a directly heated oxide cathode according to claim 1, which comprises 80.6% by weight of nickel, 15.0% by weight of molybdenum, 0.4% by weight of zirconium and 4.0% by weight of tungsten.

3. A base metal plate material for a directly heated oxide cathode according to claim 1, which consists of said molybdenum, said tungsten, said zirconium, and said nickel.

4. A base metal plate material for a directly heated oxide cathode according to claim 1, said material having been formed into a base for a directly heated oxide cathode, with the base being adapted to have an oxide layer on said base.

* * * * *